US007029300B2

(12) United States Patent
Tsai

(10) Patent No.: US 7,029,300 B2
(45) Date of Patent: Apr. 18, 2006

(54) ELECTRICAL CONNECTOR HAVING AN ELASTIC ENGAGEMENT ARM AND AN ELASTIC EJECTION ARM

(76) Inventor: Chou Hsuan Tsai, 15F,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/104,968

(22) Filed: Apr. 12, 2005

(65) Prior Publication Data

US 2005/0233624 A1 Oct. 20, 2005

(30) Foreign Application Priority Data

Apr. 19, 2004 (TW) ..... 93110808 A
Mar. 10, 2005 (TW) ..... 94107359 A

(51) Int. Cl.
*H01R 13/62* (2006.01)

(52) U.S. Cl. ..... 439/160

(58) Field of Classification Search ..... 439/153, 439/157, 160

See application file for complete search history.

(56) References Cited

U.S. PATENT DOCUMENTS 5,445,531 A * 8/1995 Billman et al. ..... 439/160
5,672,069 A * 9/1997 Cheng et al. ..... 439/160
6,368,124 B1 * 4/2002 Wang ..... 439/153
6,599,142 B1 * 7/2003 Bu ..... 439/157
6,916,190 B1 * 7/2005 Joist ..... 439/160

* cited by examiner

*Primary Examiner*—Truc Nguyen
(74) *Attorney, Agent, or Firm*—Pro-Techtor Int'l Services

(57) ABSTRACT

An engagement structure for engaging with a circuit board formed with first and second notches includes an elastic engagement arm and an elastic ejection arm. The engagement arm can be elastically and laterally moved and has a resting portion protruding laterally and an engagement portion for engaging with the first notch. The ejection arm can be elastically and laterally moved and has a touching portion and an inverse hook. The inverse hook is formed with a guiding bevel and a hooking surface. When the ejection arm is pushed laterally, the engagement portion gradually escapes from the second notch, the guiding bevel gradually presses the circuit board through the first notch, and the ejection arm deforms elastically. When the inverse hook completely passes through the first notch and makes the engagement portion escape from the second notch, the ejection arm rebounds such that the hooking surface hooks the circuit board.

10 Claims, 10 Drawing Sheets

ELECTRICAL CONNECTOR HAVING AN ELASTIC ENGAGEMENT ARM AND AN ELASTIC EJECTION ARM

BACKGROUND OF THE INVENTION

1. Field of the Invention

The invention relates to an electrical connector, and more particularly to an electrical connector having an elastic engagement arm and an elastic ejection arm.

2. Description of the Related Art

As shown in FIG. 1, a conventional engagement structure for an electrical connector is one-piece molded at one side of an electrical connector 10 so as to engage with a circuit board 20. The engagement structure includes an elastic handle arm 15, which has an engagement portion 16. One side of the circuit board 20 is formed with a first notch 21, and an inner end of the first notch is formed with a second notch 22. When the circuit board 20 is inserted into and connected to the electrical connector 10, the second notch 22 may engage with the engagement portion 16.

The above-mentioned prior art has the following drawbacks.

1. When the circuit board 20 is taken out, one hand has to pull the elastic handle arm 15 to make the engagement portion 16 escape from the second notch 22 engaging with the circuit board 20, and the other hand has to take the circuit board 20 simultaneously. So, the operation cannot be made conveniently.

2. The elasticity of the elastic handle arm 15 made of the plastic material is limited, and the arm 15 tends to break if the applied force is too large.

3. Because the elastic handle arm 15 has to be pulled laterally, the operation is inconveniently if the space is limited owing to the great number of the electrical elements disposed on the mainboard.

4. Because a handle 17 of the elastic handle arm 15 has to be formed and the handle has to extend outwards such that the hand can pull the handle, the overall length of the arm cannot be decreased, and the product cannot be miniaturized.

SUMMARY OF THE INVENTION

It is therefore an object of the invention to provide an electrical connector having an elastic engagement arm and an elastic ejection arm, such that only one hand is needed to insert, fix, and take out a circuit board, and the operations are convenient and are free from being influenced by ambient objects.

Another object of the invention is to provide an engagement structure for an electrical connector, wherein when an elastic ejection arm of the engagement structure is pushed to reject a circuit board, an inverse hook completely passes through a first notch of the circuit board and then naturally rebounds due to the elastic restoring force such that the hooking surface hooks one side of the circuit board. Thus, the elastic ejection arm or elastic engagement arm is free from breaking due to the too-large pushing force.

Still another object of the invention is to provide an engagement structure for an electrical connector having a small size to facilitate the miniaturization of the electrical product.

To achieve the above-mentioned objects, the invention provides an engagement structure of an electrical connector for engaging with a circuit board. One side of the circuit board is formed with a first notch, and an inner side of the first notch is formed with a second notch. The engagement structure of the electrical connector includes an elastic engagement arm and an elastic ejection arm. The elastic engagement arm can be elastically and laterally moved and has one connection end and one free end. A resting portion protruding laterally and an engagement portion for engaging with the first notch of the circuit board are formed near the free end. The elastic ejection arm can be elastically and laterally moved and has a connection end and a free end. A touching portion and an inverse hook are formed near the free end of the elastic ejection arm. The inverse hook is formed with a guiding bevel and a hooking surface. When the elastic ejection arm is pushed laterally, the touching portion touches the resting portion of the elastic engagement arm to make the elastic engagement arm expand outwards, such that the engagement portion gradually escapes from the second notch of the circuit board, the guiding bevel of the inverse hook of the elastic ejection arm gradually presses the circuit board through the first notch, and the elastic ejection arm deforms elastically. When the inverse hook of the elastic ejection arm completely passes through the first notch and makes the engagement portion of the elastic engagement arm escape from the second notch, the elastic ejection arm rebounds such that the hooking surface of the inverse hook hooks the circuit board.

According to the above-mentioned structure, during the process of pushing the elastic ejection arm to eject the circuit board, the elastic engagement arm is effectively positioned and is free from rebounding because the hooking surface hooks one surface of the circuit board. Hence, the elastic ejection arm may be loosened and then the circuit board may be taken out. So, the operation may be made using only one hand.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
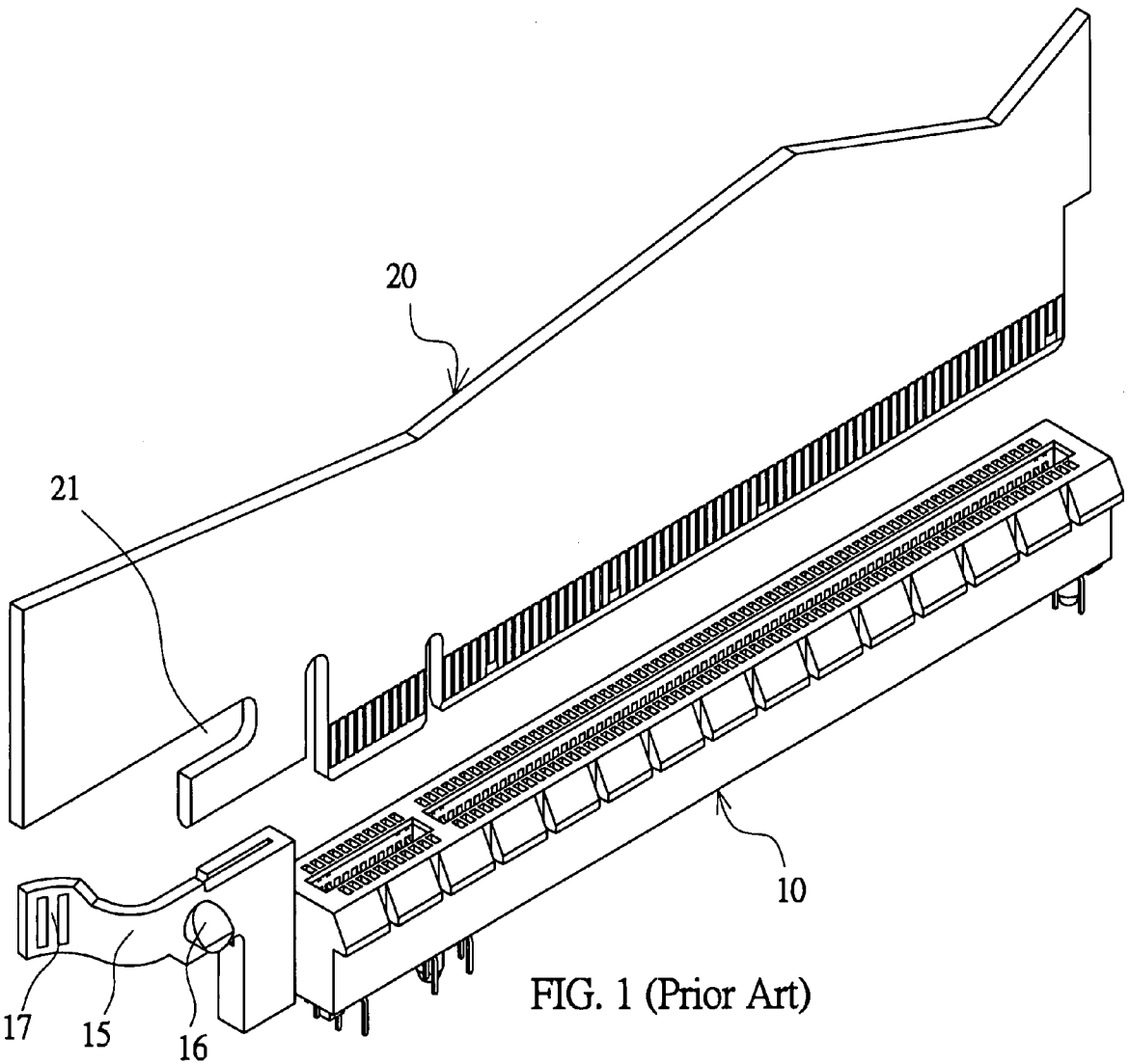
FIG. 1 (Prior Art)
FIG. 1 is a pictorially exploded view showing an electrical connector and a circuit board according to the prior art.
Figure 2:
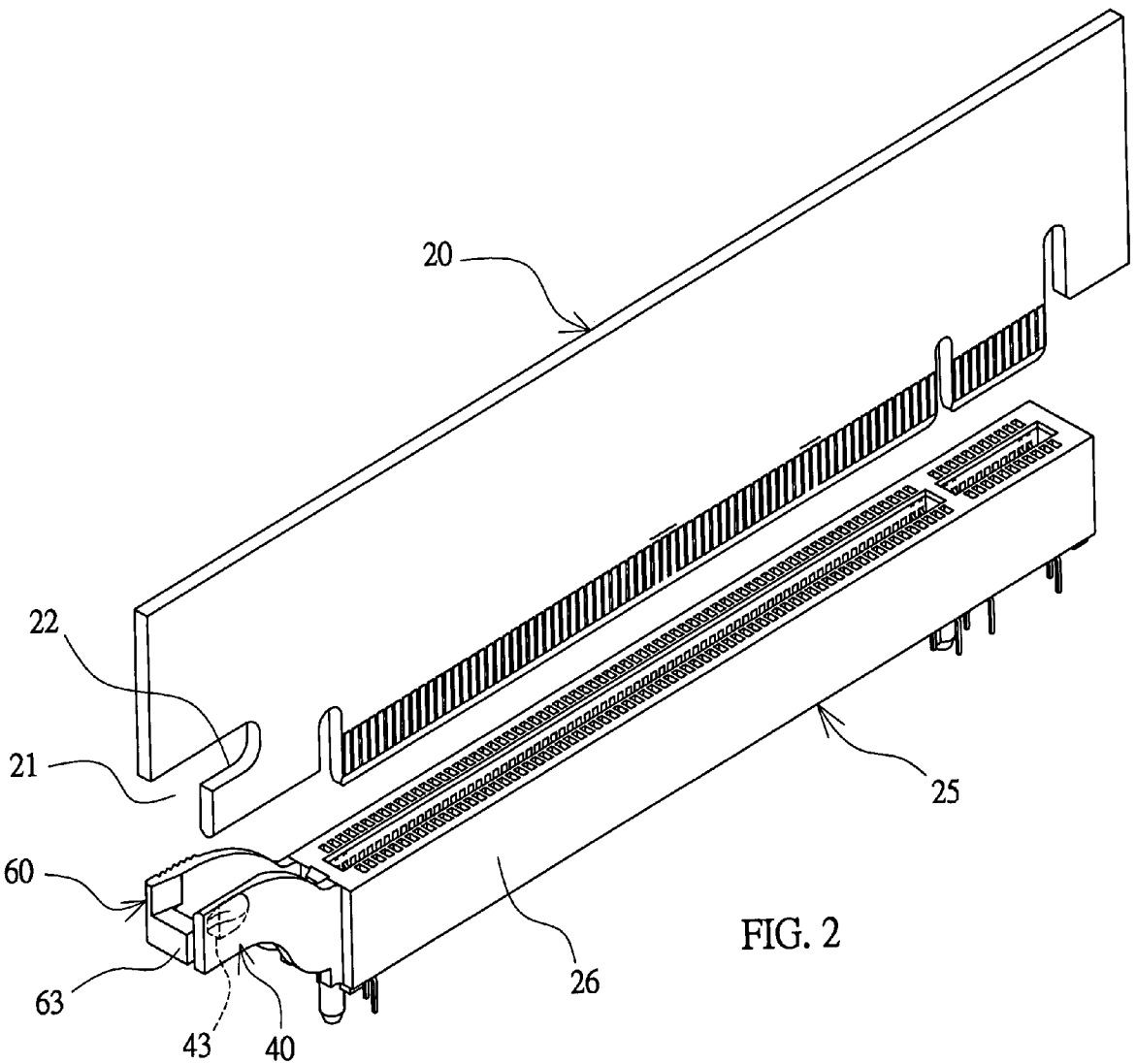
FIG. 2 is a pictorially exploded view showing an electrical connector and a circuit board according to a first embodiment of the invention.
Figure 3:
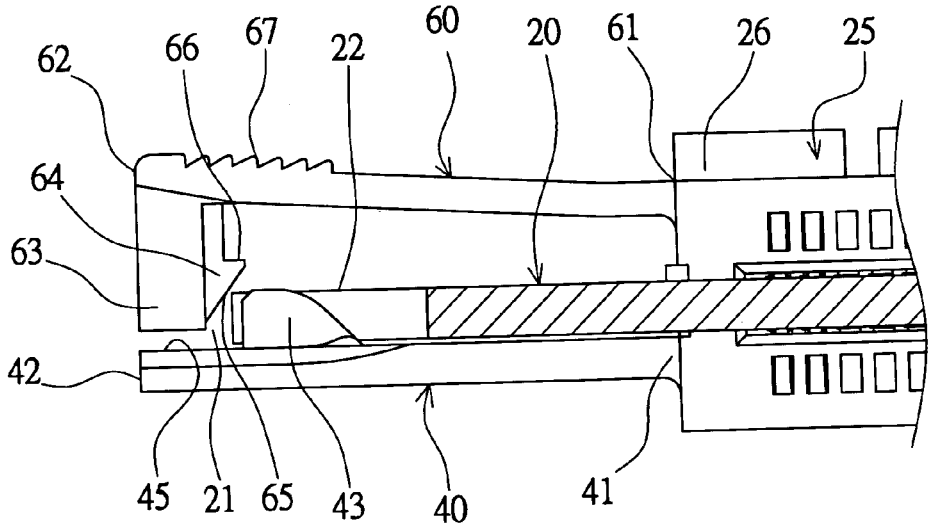
FIG. 3 is an assembled top view showing the electrical connector and the circuit board according to the first embodiment of the invention.

Referring to FIGS. 2 and 3, an engagement structure of an electrical connector of the invention is used to engage with a circuit board 20 of an inserted electrical connector 25. The circuit board 20 is formed with a first notch 21 at one side thereof. The inner side of the first notch 21 is formed with a second notch 22. The engagement structure of this embodiment is one-piece molded at a side of a plastic base 26 of the electrical connector 25 and has one elastic engagement arm 40 and an elastic ejection arm 60.

Figure 4:
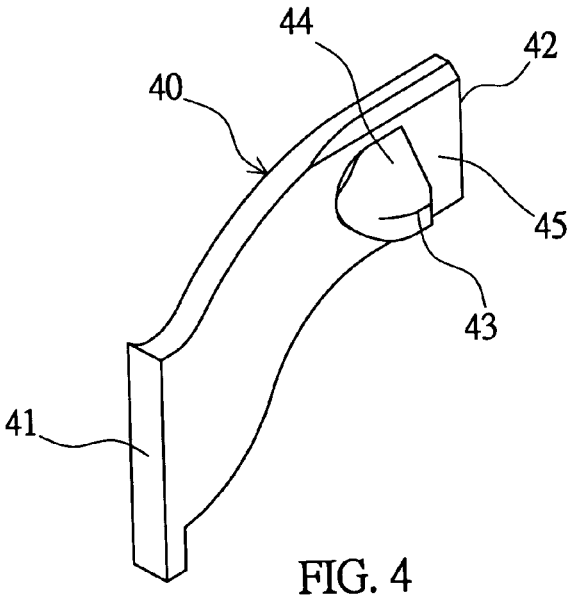
FIG. 4 is a pictorial view showing an elastic engagement arm according to the first embodiment of the invention.

As shown in FIG. 4, the elastic engagement arm 40 may be elastically and laterally moved and has a connection end 41 and a free end 42. The connection end 41 is connected to one side of the plastic base 26 of the electrical connector 25. An engagement portion 43, which protrudes laterally, and a resting portion 45 are formed near the free end 42. The engagement portion 43 can engage with the first notch 21 of the circuit board 20 and is formed with a guiding bevel 44.

Figure 5:
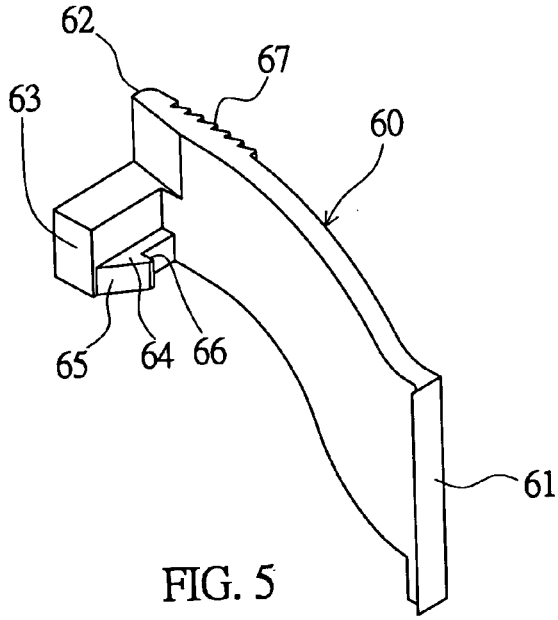
FIG. 5 is a pictorial view showing an elastic ejection arm according to the first embodiment of the invention.

As shown in FIG. 5, the elastic ejection arm 60 may be elastically and laterally moved and has a connection end 61 and a free end 62. The connection end 61 is connected to one side of the plastic base 26 of the electrical connector 25. One side of the free end 62 is formed with a touching portion 63 and an inverse hook 64 both extending toward the elastic engagement arm 40. The inverse hook 64 has a guiding bevel 65 and a hooking surface 66. The inverse hook 64 is formed at an inner end of the touching portion 63, and the guiding bevel 65 of the inverse hook 64 extends transversely. The backside of the touching portion 63 is formed with a rough pressing portion 67. When the elastic ejection arm 60 is pushed laterally, the touching portion 63 touches the resting portion 45 of the elastic engagement arm 40 to make the elastic engagement arm 40 expand outwards such that the engagement portion 43 gradually escapes from the second notch 22 of the circuit board 20, and the guiding bevel 65 of the inverse hook 64 of the elastic ejection arm 60 gradually presses the circuit board 20 through the first notch 21.

The operations of the above-mentioned structure are described in the following.

As shown in FIG. 3, when the circuit board 20 is inserted into the electrical connector, the bottom of the circuit board 20 firstly touches the guiding bevel 44 of the engagement portion 43 to make the elastic engagement arm 40 elastically expand outwards. After the circuit board 20 is inserted and positioned, the elastic engagement arm 40 rebounds such that the engagement portion 43 engages with the second notch 22 of the circuit board to position the circuit board 20.

Figure 6:
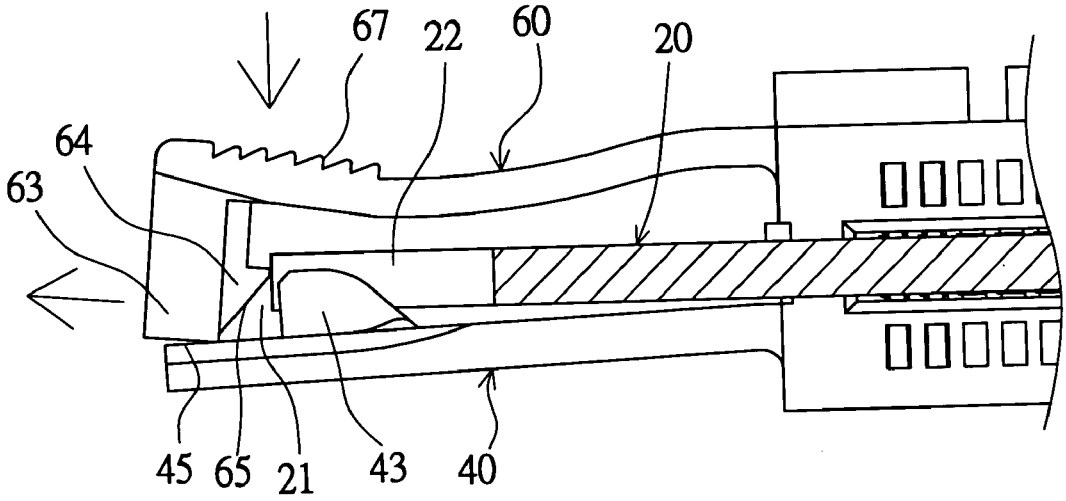
FIGS. 6 to 8 are top views showing usage states according to the first embodiment of the invention.
Figure 7:
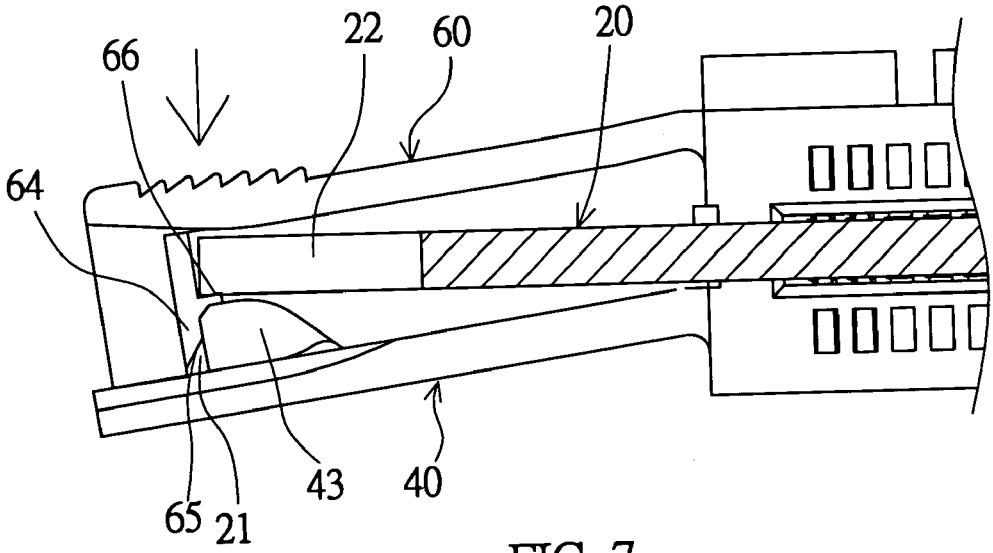
Figure 8:
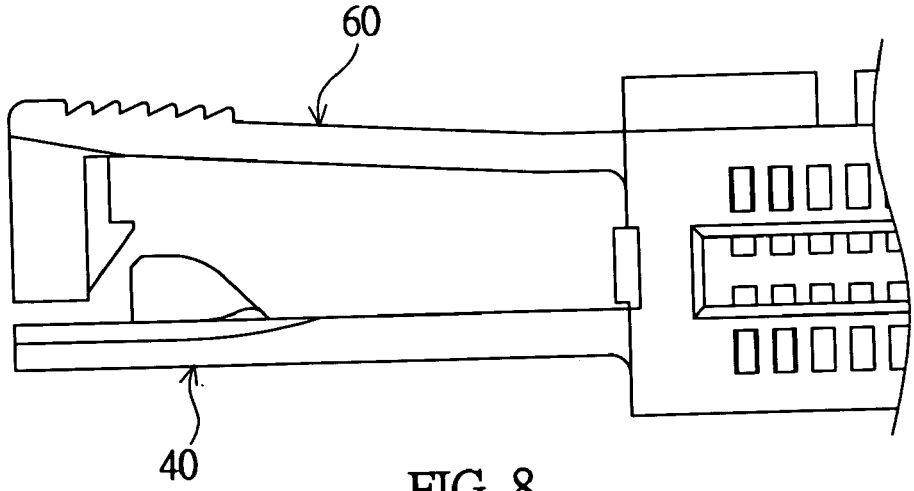

When the circuit board 20 is to be taken out, as shown in FIG. 6, the elastic ejection arm 60 is pushed toward the elastic engagement arm 40 from the pressing portion 67, and the touching portion 63 touches the resting portion 45 of the elastic engagement arm 40. Thus, the elastic engagement arm 40 elastically moves outwards and the engagement portion 43 gradually escapes from the second notch 22 of the circuit board 20. Also, the guiding bevel 65 of the inverse hook 64 of the elastic ejection arm 60 gradually presses the circuit board 20 through the first notch 21 such that the elastic ejection arm 60 is elastically deformed into a curved shape. As shown in FIG. 7, when the inverse hook 64 of the elastic ejection arm 60 completely passes through the first notch 21 and makes the engagement portion 43 of the elastic engagement arm 40 escape from the second notch 22, the guiding bevel 65 of the inverse hook 64 does not push the circuit board 20. So, the elastic ejection arm 60 rebounds such that the hooking surface 66 of the inverse hook 64 hooks the circuit board 20. Consequently, the elastic ejection arm 60 and the elastic engagement arm 40 may be temporarily positioned to disengage the engagement portion 43 of the elastic engagement arm 40 from the second notch 22 of the circuit board 20. So, the hand that originally pushes the elastic ejection arm 60 is free to take the circuit board 20 out. As shown in FIG. 8, after the circuit board 20 is taken out, the elastic ejection arm 60 and the elastic engagement arm 40 rebound to the original shapes.

According to the descriptions mentioned hereinabove, the invention has the following advantages.

1. Instead of pulling the elastic ejection arm outwards, the elastic ejection arm 60 may be conveniently pushed, and the pushing stroke is within the range of the width of the base. So, no addition space is needed, and the ambient objects cannot influence the operation of the arm 60.

2. When the elastic ejection arm 60 is pushed to make the engagement portion 43 of the elastic engagement arm 40 escape from the engagement structure, the hooking surface 66 of the inverse hook 64 of the elastic ejection arm can hook the circuit board such that the elastic engagement arm 40 can be effectively positioned without rebounding. Hence, the elastic ejection arm 60 may be loosened and then the circuit board 20 may be taken out. So, the operation may be made using only one hand.

3. When the elastic ejection arm 60 is pushed in the ejection process, the inverse hook 64 completely passes through the first notch 21 and then naturally rebounds due to the elastic restoring force such that the hooking surface 66 hooks the circuit board. So, the elastic ejection arm or elastic engagement arm is free from breaking due to the too-large force, and the operations may be made stably.

4. The invention is formed with the engagement structure only at a location corresponding to the first notch of the circuit board. In addition, the operation is not made in a pulling manner, and the handle of the elastic arm does not need to be held by the hand. So, the downward and outward extending lengths of the invention are small, and the size of the connector may be made small, thereby facilitating the miniaturization of the electrical product.

Figure 9:
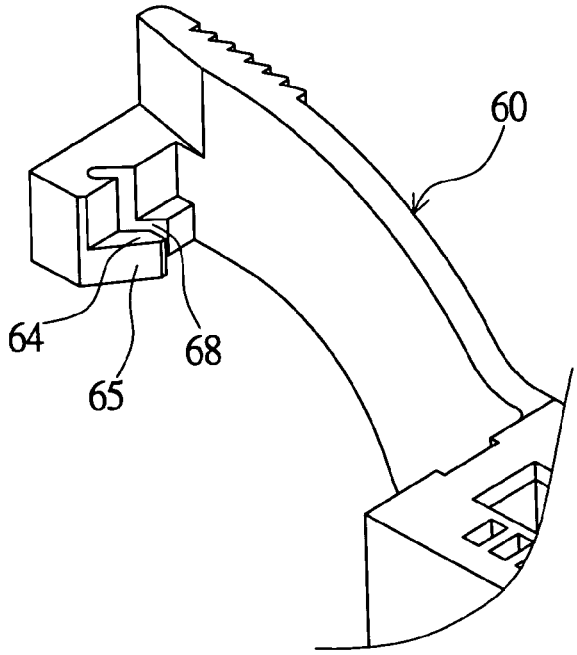
FIG. 9 is a pictorial view showing an elastic engagement arm according to a second embodiment of the invention.
Figure 10:
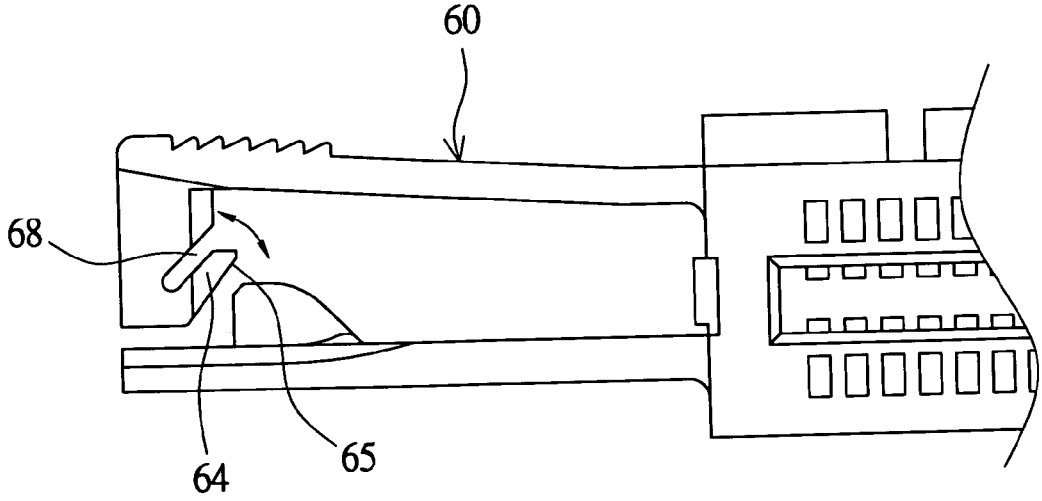
FIG. 10 is a top view showing the second embodiment of the invention.

As shown in FIGS. 9 and 10, the second embodiment of the invention is similar to the first embodiment except that the inverse hook 64 of the elastic ejection arm 60 has a compressible space 68 to possess the elastic effect such that the guiding bevel 65 of the inverse hook 64 pushes the circuit board in a more flexible manner and the force may be easily applied.

Figure 11:
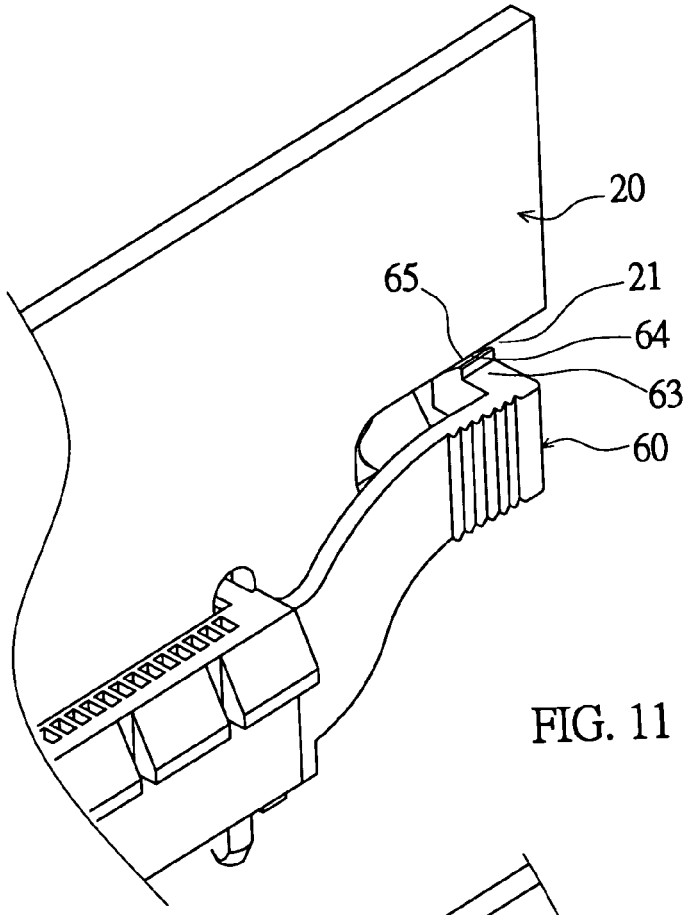
FIG. 11 is a pictorially assembled view showing an electrical connector and a circuit board according to a third embodiment of the invention.
Figure 12:
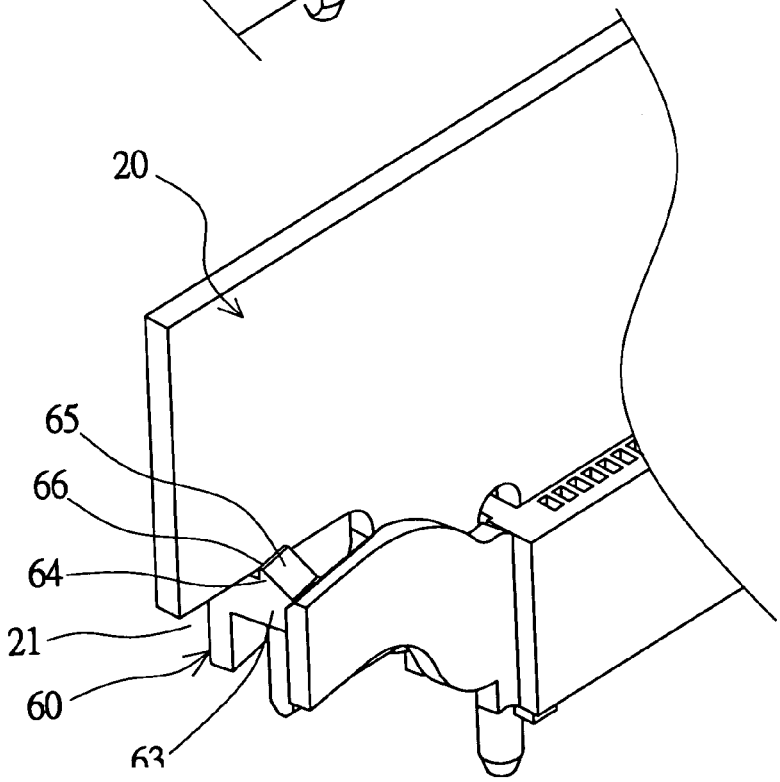
FIG. 12 is a pictorial view showing a usage state according to the third embodiment of the invention.

As shown in FIG. 11, the third embodiment of the invention is similar to the first embodiment except that the inverse hook 64 of the elastic ejection arm 60 is disposed on a top of the touching portion 63, and the guiding bevel 65 of the inverse hook 64 extends longitudinally. As shown in FIG. 12, when the elastic ejection arm 60 is pushed toward the elastic engagement arm 40, the inverse hook 64 of the elastic ejection arm 60 completely passes through the first notch 21 to make the engagement portion 43 of the elastic engagement arm 40 escape from the second notch 22. At this time, the elastic ejection arm 60 slightly rebounds such that the hooking surface 66 of the inverse hook hooks the upper edge of the first notch 21 of the circuit board 20. Hence, the hand originally pressing the elastic ejection arm is free to take the circuit board 20 out.

Figure 13:
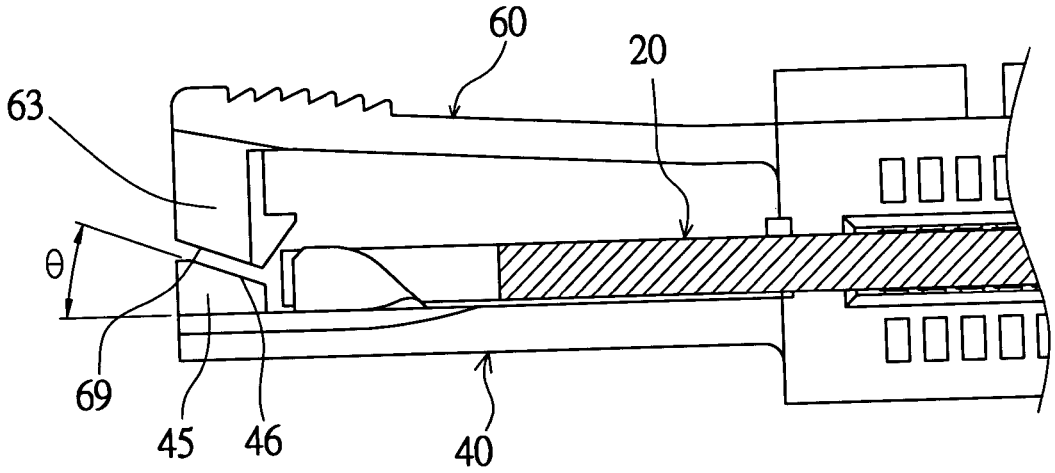
FIG. 13 is an assembled top view showing an electrical connector and a circuit board according to a fourth embodiment of the invention.

As shown in FIG. 13, the fourth embodiment of the invention is similar to the first embodiment except that the resting portion 45 of the elastic engagement arm 40 is formed with a tilted resting surface 46. The angle θ between the resting surface 46 and the elastic engagement arm 40 ranges from 10 to 25 degrees. The touching portion 63 of the elastic ejection arm 60 is formed with a tilted touching surface 69 corresponding to the resting surface 46 of the resting portion 45 of the elastic engagement arm 40.

Figure 14:
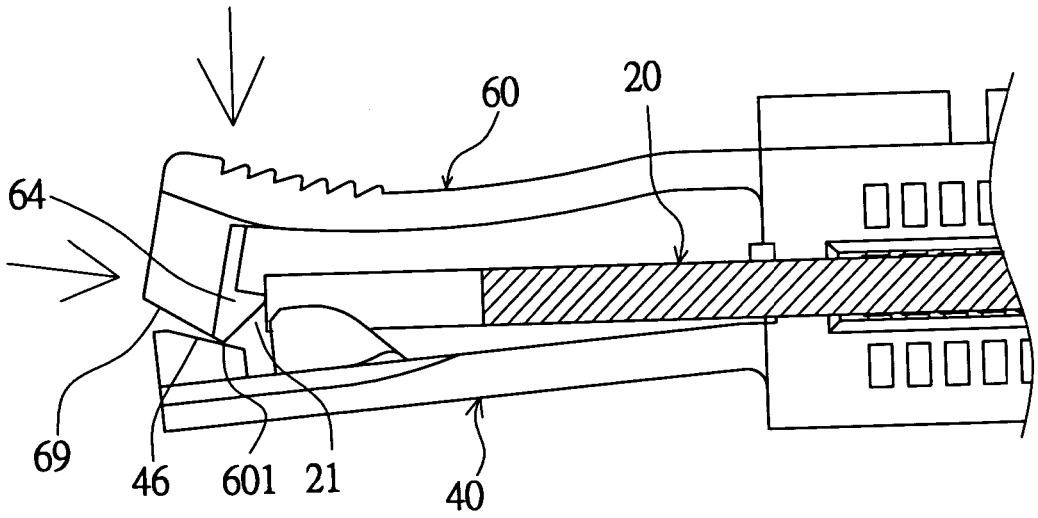
FIG. 14 is a top view showing a usage state according to the fourth embodiment of the invention.

As shown in FIG. 14, when the elastic ejection arm 60 is pushed, the touching surface 69 pushes the resting surface 46 to make the elastic engagement arm 40 expand outwards. Because the angle θ is formed between the resting surface 46 and the elastic engagement arm 40, the dead zone formed by the tip 601 of the edge of the touching surface 69 resting on the resting surface 46 may be reduced. Thus, after the inverse hook 64 passes through the first notch 21 of the circuit board 20, the elastic ejection arm 60 tends to rebound and rest on a surface of the circuit board 20 without being locked with the elastic engagement arm 40.

Figure 15:
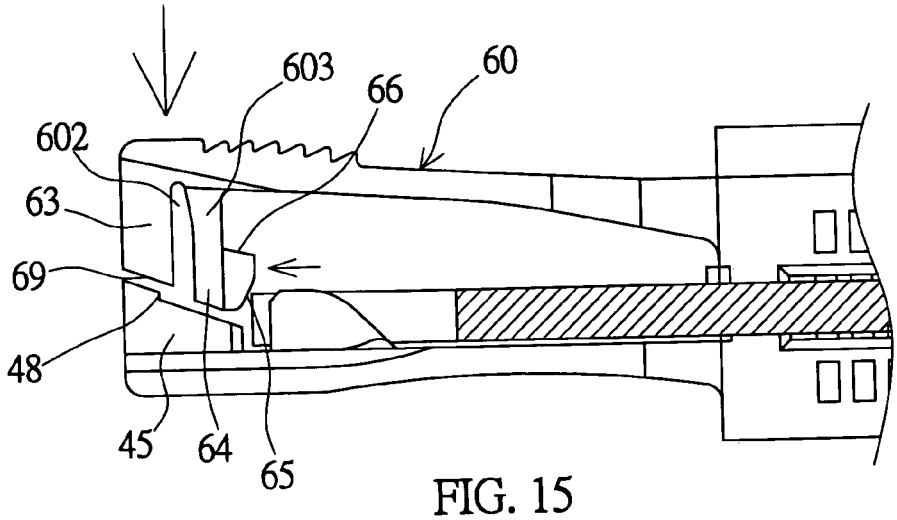
FIGS. 15 and 16 are top views showing usage states according to a fifth embodiment of the invention.
Figure 16:
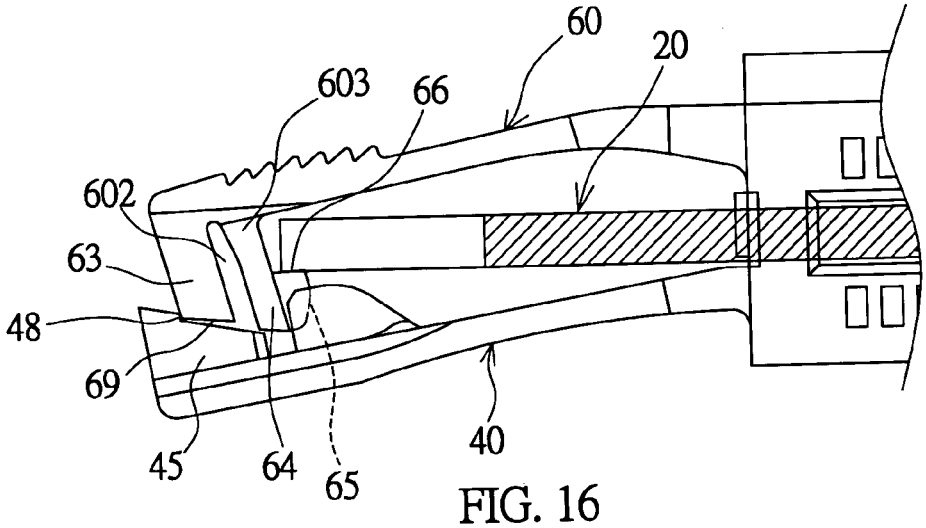

As shown in FIG. 15, the fifth embodiment of the invention is similar to the fourth embodiment except that the inverse hook 64 of the elastic ejection arm 60 is spaced apart from the touching portion 63 to form a compressible space 602, and the inverse hook 64 has an elastic arm 603 connected to an inner side of the elastic ejection arm 60 so as to possess a better elastic effect. Consequently, the guiding bevel 65 of the inverse hook 64 may push the circuit board in a more flexible manner and the force may be easily applied. In addition, as shown in FIG. 16, the resting portion 45 has an engaging surface 48. When the hook 64 of the elastic ejection arm 60 engages with the circuit board 20, the engaging surface 48 can engage with the outer side of the touching portion 63 so as to enable the elastic engagement arm 40 to assist the elastic ejection arm 60 in engaging with the circuit board 20 without the all the forces being received by the elastic ejection arm 60. When the circuit board 20 is taken away, the rebounding force of the elastic ejection arm is larger than that for locking the engaging surface 48. Thus, the elastic ejection arm can recover to the original shape.

Figure 17:
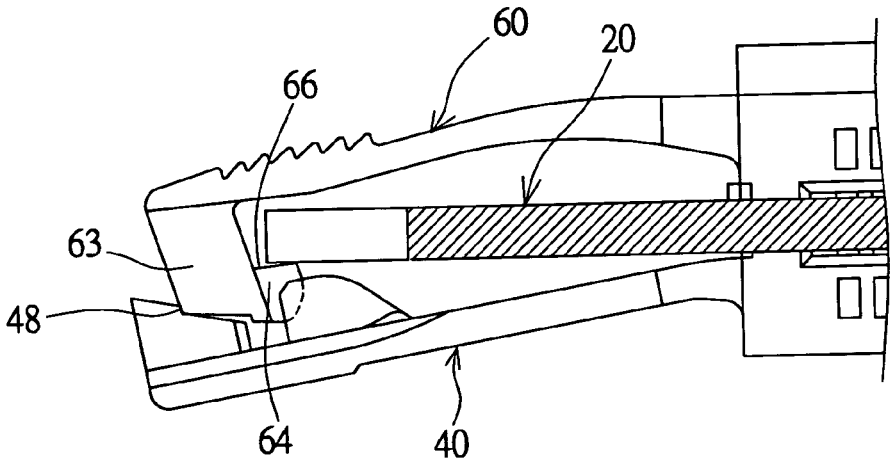
FIG. 17 is a top view showing a usage state according to a sixth embodiment of the invention.

As shown in FIG. 17, the sixth embodiment of the invention is similar to the fourth embodiment except that the resting portion 45 has an engaging surface 48. When the hook 64 of the elastic ejection arm 60 engages with the circuit board 20, the engaging surface 48 can engage with the outer side of the touching portion 63 so as to enable the elastic engagement arm 40 to assist the elastic ejection arm 60 in engaging with the circuit board 20 without all the forces being received by the elastic ejection arm 60.

Figure 18:
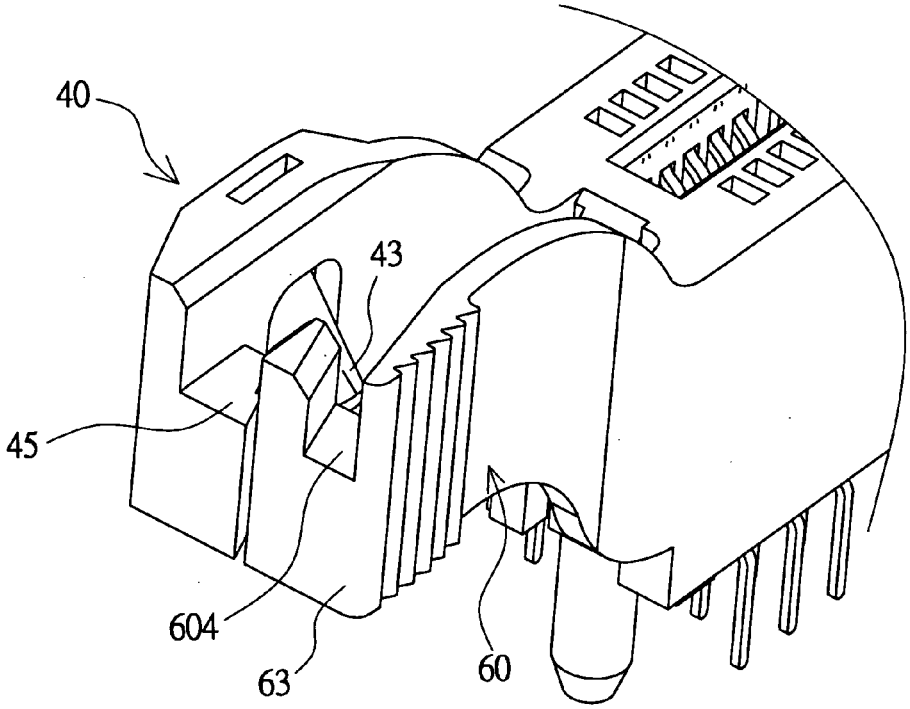
FIG. 18 is a pictorial view showing an electrical connector according to a seventh embodiment of the invention.
Figure 19:
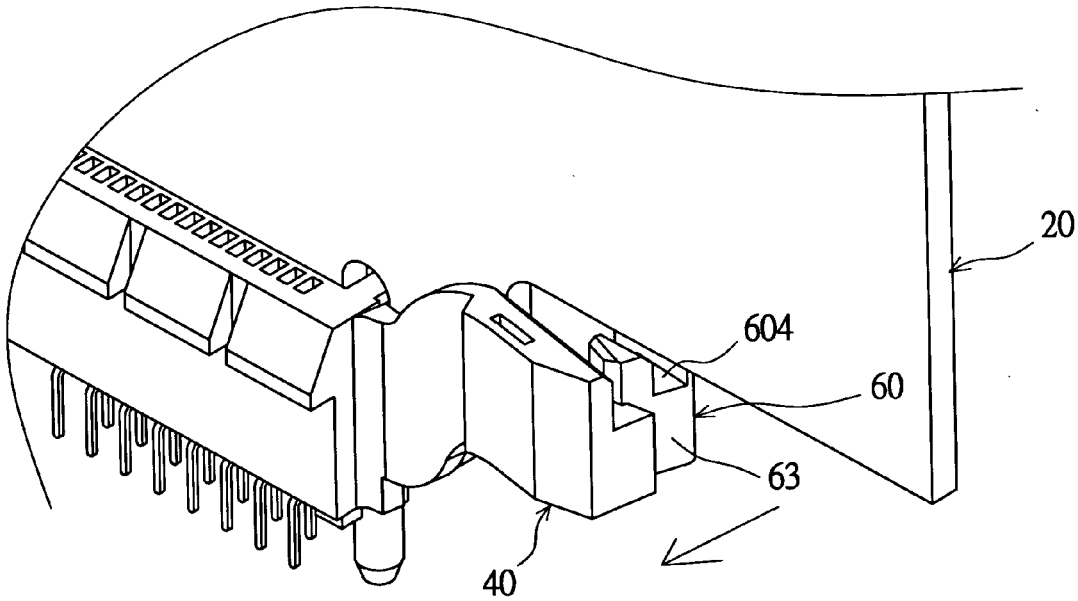
FIGS. 19 and 20 are top views showing usage states according to the seventh embodiment of the invention.
Figure 20:
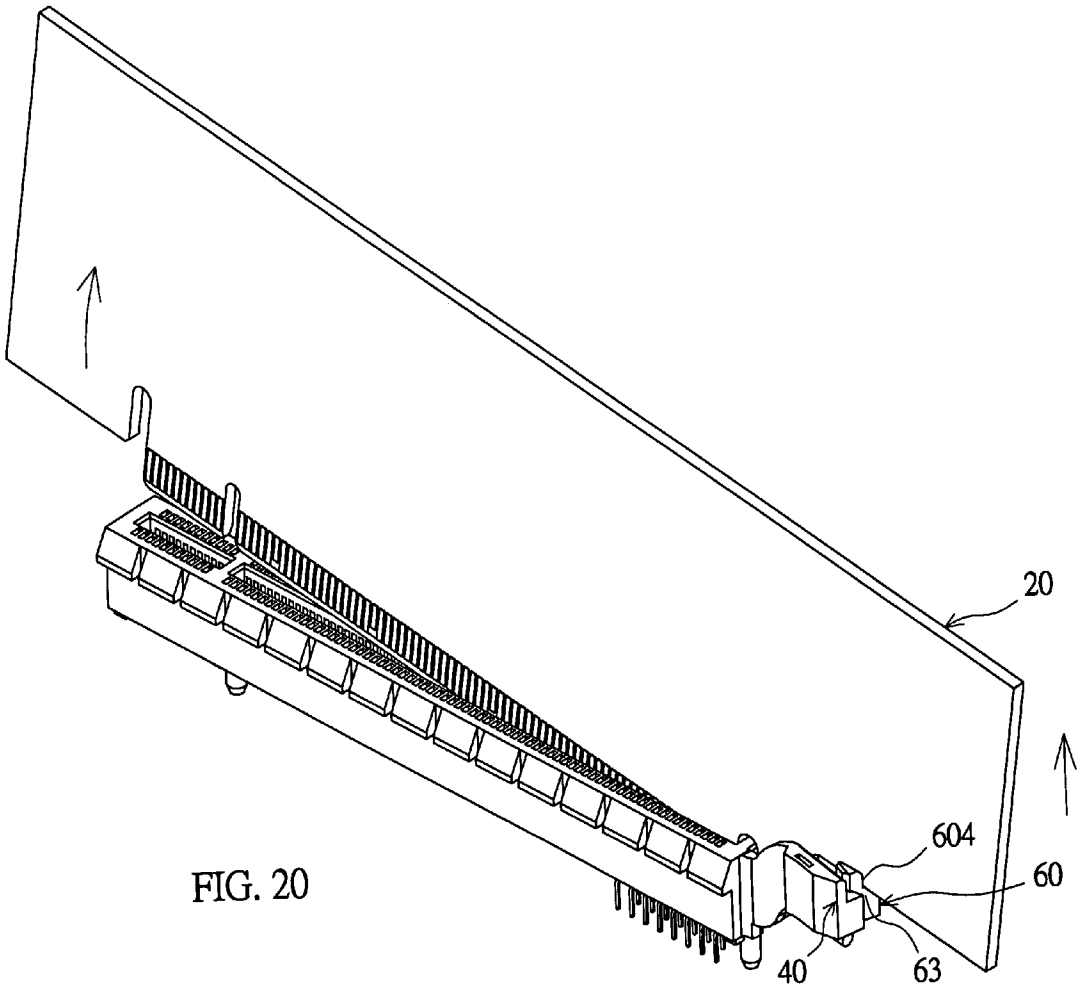

As shown in FIG. 18, the seventh embodiment of the invention is similar to the sixth embodiment except that the top of the touching portion 63 of the ejection arm 60 is formed with an engagement slot 604. As shown in FIG. 19, when the ejection arm 60 is pushed to make the engagement arm 40 expand outwards, the engagement portion of the engagement arm 40 escapes from the circuit board 20 while the hook 64 of the ejection arm 60 hooks the circuit board 20 (FIG. 17). At this time, the circuit board 20 may be removed upwards. As shown in FIG. 20, because the top of the touching portion 63 is formed with the engagement slot 604, the circuit board 20 may also be taken out by way of rotation. That is, when the circuit board 20 is rotated, the lower edge at one end of the circuit board 20 may enter the engagement slot 604 so that the ejection arm 60 is locked and cannot rebound, and then the circuit board 20 may be removed upwards. This embodiment provides another operation way for the user.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An engagement structure of an electrical connector for engaging with a circuit board, one side of the circuit board being formed with a first notch, and an inner side of the first notch being formed with a second notch, the engagement structure of the electrical connector comprising:

an elastic engagement arm, which can be elastically and laterally moved and has one connection end and one free end, a resting portion protruding laterally and an engagement portion for engaging with the first notch of the circuit board being formed near the free end; and an elastic ejection arm, which can be elastically and laterally moved and has a connection end and a free end, a touching portion and an inverse hook being formed near the free end of the elastic ejection arm, wherein:

the inverse hook is formed with a guiding bevel and a hooking surface;

when the elastic ejection arm is pushed laterally, the touching portion touches the resting portion of the elastic engagement arm to make the elastic engagement arm expand outwards, such that the engagement portion gradually escapes from the second notch of the circuit board, the guiding bevel of the inverse hook of the elastic ejection arm gradually presses the circuit board through the first notch, and the elastic ejection arm deforms elastically; and when the inverse hook of the elastic ejection arm completely passes through the first notch and makes the engagement portion of the elastic engagement arm escape from the second notch, the elastic ejection arm rebounds such that the hooking surface of the inverse hook hooks the circuit board.

2. The engagement structure according to claim 1, wherein the inverse hook of the elastic ejection arm is formed at an inner end of the touching portion, and the guiding bevel of the inverse hook extends transversely.

3. The engagement structure according to claim 1, wherein the inverse hook of the elastic ejection arm has a compressible space to possess an elastic effect.

4. The engagement structure according to claim 1, wherein the inverse hook of the elastic ejection arm is disposed on a top of the touching portion, and the guiding bevel of the inverse hook extends longitudinally.

5. The engagement structure according to claim 1, wherein the engagement portion of the elastic engagement arm has a guiding bevel.

6. The engagement structure according to claim 1, wherein the resting portion of the elastic engagement arm is formed with a tilted resting surface, and the touching portion of the elastic ejection arm is formed with a tilted touching surface corresponding to the resting surface of the resting portion of the elastic engagement arm.

7. The engagement structure according to claim 1, wherein the resting portion of the elastic engagement arm has an engaging surface for engaging with an outer side of the touching portion when the hook of the elastic ejection arm engages with the circuit board.

8. The engagement structure according to claim 1, wherein the ejection arm is formed with an engagement slot.

9. The engagement structure according to claim 6, wherein an angle between the resting surface of the resting portion of the elastic engagement arm and the elastic engagement arm ranges from 10 to 25 degrees.

10. The engagement structure according to claim 6, wherein the resting portion of the elastic engagement arm has an engaging surface for engaging with an outer side of the touching portion when the hook of the elastic ejection arm engages with the circuit board.

* * * * *